US007068969B2

(12) United States Patent
Ueda

(10) Patent No.: US 7,068,969 B2
(45) Date of Patent: Jun. 27, 2006

(54) METHOD AND APPARATUS FOR IMAGE FORMING CAPABLE OF PERFORMING FAST AND STABLE SHEET TRANSFER OPERATIONS

(75) Inventor: Kenji Ueda, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 10/841,508

(22) Filed: May 10, 2004

(65) Prior Publication Data

US 2004/0223797 A1 Nov. 11, 2004

(30) Foreign Application Priority Data

May 9, 2003 (JP) ..... 2003-132128

(51) Int. Cl.
*G03G 15/00* (2006.01)

(52) U.S. Cl. ..... 399/388; 399/396; 400/624; 400/625; 271/10.02; 271/10.03; 271/258.01; 271/265.01; 271/265.02

(58) Field of Classification Search ..... 271/10.01, 271/10.02, 10.03, 258.01, 259, 265.01, 265.02; 400/578, 624, 625; 399/381, 388, 396
See application file for complete search history.

(56) References Cited

U.S. PATENT DOCUMENTS 5,848,784 A * 12/1998 Tranquilla ..... 271/10.03
6,189,884 B1 * 2/2001 Jeske ..... 271/182
6,341,774 B1 1/2002 Ueda
6,382,618 B1 * 5/2002 Takada ..... 271/10.01
6,533,263 B1 * 3/2003 Tamura ..... 271/10.01
6,629,795 B1 * 10/2003 Kinoshita et al. ..... 400/582
6,757,515 B1 6/2004 Ueda

FOREIGN PATENT DOCUMENTS

| | | |
|---|---|---|
| JP | 9-249333 | 9/1997 |
| JP | 11-59954 | 3/1999 |
| JP | 11-59965 | 3/1999 |
| JP | 2001-206583 | 7/2001 |

* cited by examiner

*Primary Examiner*—Daniel J. Colilla
*Assistant Examiner*—Dave A. Ghatt
(74) *Attorney, Agent, or Firm*—Oblon, Spivak, McClelland, Maier & Neustadt, P.C.

(57) ABSTRACT

Image forming methods and apparatuses capable of performing stable and fast sheet transfer operations are provided. In a continuous feed mode, a preceding sheet and a succeeding sheet are successively fed from a sheet tray through first and second transfer rollers to an image forming position. When it is determined that a trailing edge of the preceding sheet has passed the first transfer roller, the driving of the first transfer roller is stopped for a predetermined time period. As a result, the preceding sheet and the succeeding sheet are transferred with a desired sheet interval while suppressing sheet interval variations.

27 Claims, 18 Drawing Sheets

| |
|---|
| FIG. 11A |
| FIG. 11B |

METHOD AND APPARATUS FOR IMAGE FORMING CAPABLE OF PERFORMING FAST AND STABLE SHEET TRANSFER OPERATIONS

This patent specification is based on Japanese patent application, No. JPAP2003-132128 filed on May 9, 2003, in the Japanese Patent Office, the entire contents of which are incorporated by reference herein.

BACKGROUND OF THE INVENTION

1. Field of the Invention

The present invention relates to a method and apparatus for image forming, and more particularly to a method and apparatus for image forming capable of performing fast and stable sheet transfer operations by using an improved sheet transfer apparatus.

2. Discussion of the Background

FIG. 1 is a schematic cross-sectional view illustrating a background sheet transfer apparatus 1 for use in a background image forming apparatus, such as a printer, a copier, a facsimile, etc. The background sheet transfer apparatus 1 has a sheet passage for a recording sheet P travelling from a sheet tray 2 through an image transfer position where a photoconductor 12 and an image transfer roller 13 are provided. Along the sheet passage, a plurality of rollers and a plurality of sensors are provided. A controller 11, connected to the plurality of rollers and sensors, electrically controls the operation of the background sheet transfer apparatus 1. As shown in FIG. 1, the plurality of rollers include a pick-up roller 3, a feed roller 4*a*, a reverse roller 4*b*, a pair of first transfer rollers 5, a pair of second transfer rollers 6, and a pair of registration rollers 10. The pair of first transfer rollers 5, the pair of second transfer rollers 6, and the pair of registration rollers 10 will be referred to as the first transfer roller 5, the second transfer roller 6, and the registration roller 10, respectively. The plurality of sensors include a sensor 7, a transfer sensor 8, and a registration sensor 9. As for these sensors, any kind of reflective sensor is preferably used such as, for example, a photosensor.

In FIG. 1, the sheet tray 2 contains therein a stack of recording sheets P such that their leading edges are substantially aligned at position A of the downstream side of the sheet tray 2. At the starting of a sheet transfer operation, the controller 11 sends a sheet feed signal to the background sheet transfer apparatus 1. With the sheet feed signal, the pick-up roller 3 is rotated and lowered so as to move the recording sheets P to position B where the feed roller 4*a* and the reverse roller 4*b* are provided. The feed roller 4*a* moves forward one of the recording sheets P, while the reverse roller 4*b* moves back the rest of the recording sheets P. In other words, the recording sheet P placed on the top of the stack is separated from the rest of the recording sheets P, and is transferred to position C where the sensor 7 is provided.

When the sensor 7 detects the leading edge of the recording sheet P at position C, the pick-up roller 3 is lifted and no longer driven. As a result, the recording sheet P is carried by the feed roller 4*a* to position E where the first transfer roller 5 is provided.

Once the leading edge of the recording sheet P reaches position E, the driving of feed roller 4*a* is stopped. As a result, the recording sheet P is transferred by the first transfer roller 5, through position G of the transfer sensor 8, to position E' of the second transfer roller 6.

When the transfer sensor 8 detects the leading edge of the recording sheet P at position G, the controller 11 instructs the background image forming apparatus to start an image writing process on the photoconductor 12. In this example, the first transfer roller 5 and the second transfer roller 6 are driven by a transfer roller driving motor (not shown) controlled by the controller 11.

Subsequently, the leading edge of the recording sheet P is transferred to position I, where the registration sensor 9 is provided. At this time, the registration roller 10 is not driven until the leading edge of the recording sheet P reaches position J where the registration roller 10 is provided. As a result, a skew correction can be performed. That is, the recording sheet P slacks before the registration roller 10 to correct a skew of the recording sheet P if one exists.

After the skew correction, the driving of first and second transfer rollers 5 and 6 is stopped so that a registration correction may take place. That is, the movement of the recording sheet P is timed in synchronization with the rotation of the photoconductor 12 so that the position of the image matches the corresponding position of the recording sheet P.

After the skew correction, the registration roller 10, and the first and second transfer rollers 5 and 6 start rotating. Consequently, the recording sheet P is transferred to position K, where the photoconductor 12 and the image transfer roller 13 are provided, and the image transfer operation is performed.

The background sheet transfer apparatus 1, since the skew correction and the registration correction are performed right before the image transfer operation, temporarily stops the recording sheet P before the registration roller 10. Therefore, the recording sheets P, being continuously fed from the sheet tray 2, are transferred in such a manner that a sheet interval between the trailing edge of a preceding sheet P1 and the leading edge of a succeeding sheet P2 is generated, sufficiently preventing the superposition. In the background sheet transfer apparatus 1, a large sheet interval is provided in consideration of the variation in sheet interval, caused by the variation in recording sheet slippage from position to position along the sheet passage or the variation in the sheet initial position.

The slippage of the recording sheet P varies depending on the relationship between the roller transfer power, in this example, one of the above-described rollers transferring the recording sheet P, and the load being applied by the roller to the recording sheet P. If the transfer power is sufficiently large relative to the load, the recording sheet P can be transferred at a stable speed while causing less slippage. On the-other hand, if the load is sufficiently large relative to the transfer power, the recording sheet P is transferred at a slower speed while causing greater slippage. This relationship between the transfer power and the load varies from position to position in the sheet passage. More specifically, the load applied by the roller varies depending on various conditions including the size, type, or surface of the recording sheet P being transferred. The load is varied depending on the friction coefficient of the roller in use, which is reduced due to wear over time, and deposition of paper dust or foreign substances on the rollers.

As a result, slippage occurs as the recording sheet P passes each roller in the sheet passage, causing the interval sheet variations as explained.

In the background sheet transfer apparatus 1, recording sheets usually experience a large amount of slippage at position B due to the large load generated at the nip between the feed roller 4*a* and the reverse roller 4*b*. On the other hand, at position G, where the transfer sensor 8 is provided, the sheets tend to display a smaller amount of slippage.

Thus, the background sheet transfer apparatus 1, which typically creates the sheet interval before position B, is likely to have a large sheet interval variation.

In addition, the initial position of the recording sheet P varies from sheet to sheet. Specifically, there is a sheet P transfer delay at the initial position ranging from position A to position B. In consideration of this sheet interval variation generated before position B, the background sheet transfer apparatus 1 typically requires a large sheet interval for a stable sheet transfer operation.

Recently, in order to meet the increased demand for enhanced image forming productivity, image forming apparatuses having a shorter sheet interval are needed. Such image forming apparatuses can achieve higher image forming speeds without increasing roller rotational speeds or requiring high-performance (i.e., high-cost) motors while suppressing motor noise and improving roller durability.

Therefore, in order to develop improved image forming apparatuses with short sheet intervals, sheet interval variations have to be suppressed.

SUMMARY OF THE INVENTION

In view of the foregoing, it is an object of the present invention to provide a novel image forming apparatus capable of performing fast and stable image forming and sheet transfer operations.

Another object of the present invention is to provide a novel image forming method for performing fast and stable image forming and sheet transfer operations.

In order to attain the above and other objects, in one example, a novel image forming apparatus includes an image forming mechanism and a sheet transfer apparatus. The image forming mechanism forms at least one image on a plurality of recording sheets, including a preceding sheet and a succeeding sheet transferred successively by the sheet transfer apparatus. The sheet transfer apparatus includes a sheet tray, a pick-up roller, a separator, a first transfer roller, a second transfer roller, a first sensor, and a controller. The pick-up roller successively feeds the preceding sheet and the succeeding sheet from the sheet tray without a sheet interval therebetween. The separator is arranged downstream of the pick-up roller, and separates the preceding sheet and the succeeding sheet. The first transfer roller is arranged downstream of the separator, and transfers forward the preceding sheet and the succeeding sheet. The second transfer roller is arranged downstream of the first transfer roller, and transfers forward the preceding sheet and the succeeding sheet. The first sensor is provided between the first transfer roller and the second transfer roller, and detects the presence of the preceding sheet and the succeeding sheet. The controller generates a desired sheet interval between the preceding sheet and the succeeding sheet.

In this case, the desired sheet interval generally includes a first sheet interval and a second sheet interval.

The first sheet interval is preferably generated by stopping the first transfer roller for a first time period. The first time period preferably represents a time interval from the time when the trailing edge of the preceding sheet passes the first transfer roller to when the trailing edge of the preceding sheet passes the first sensor. Further, the first time period may be previously set by the controller or determined based on the output of the first sensor. After the first time period, the first transfer roller is driven at a normal speed or a speed faster than the normal speed.

The second sheet interval is preferably generated by stopping the first transfer roller for a second time period after the leading edge of the succeeding sheet reaches the first sensor. After the second time period, the first transfer roller is driven at a speed equal to or faster than normal.

In one example, when the first transfer roller is driven at the faster speed, its speed is reduced to the normal speed after a third time period previously set by the controller. Alternatively, a second sensor may be provided so as to allow the controller to calculate the third time period.

When the second sensor is used to determine the third time period, for example, the second sensor measures an actual sheet interval between preceding and succeeding sheets. Based on the actual sheet interval, the controller calculates the third time period.

In another example, when the third time period is greater than the time period corresponding to the distance between the first sensor and the second transfer roller, the controller may drive the second transfer roller at a speed faster than the normal speed in addition to speeding up the rotation of the first transfer roller.

To attain the above and other objects, a novel image forming method includes feeding, first determining, first stopping, first generating, second determining, and first driving steps. The feeding step feeds preceding and succeeding sheets successively from the sheet tray. The first determining step determines whether a trailing edge of the preceding sheet has passed the first transfer roller. The first stopping step stops the first transfer roller based on the result of the first determining step. The first generating step generates a first sheet interval between the preceding sheet and the succeeding sheet. The second determining step determines whether the trailing edge of the preceding sheet has passed the first sensor. The first driving step drives the first transfer roller based on the result of the second determining step.

In one example, the novel image forming method may further include third determining, second stopping, and second generating steps. The third determining step determines whether a leading edge of the succeeding sheet has reached the first sensor. The second stopping step stops the first transfer roller for a first time period based on the result of the third determining step. The second generating step generates a second sheet interval between the preceding sheet and the succeeding sheet.

In another example, the novel image forming method may further include the step of second driving the first transfer roller at a normal speed.

Alternatively, the novel image forming method may further include the steps of third driving the first transfer roller at a speed faster than normal speed, and subsequently reducing its speed to the normal speed after a second time period.

In such a case, the image forming method may include the steps of measuring actual sheet intervals between preceding and succeeding sheets, and calculating second time periods based on the actual sheet intervals calculated by the measuring step.

Furthermore, the image forming method may include the steps of fourth driving the second transfer roller at a speed faster than the normal speed and substantially reducing its speed to the normal speed a second time after a third time period.

In addition to the novel image forming apparatus and the novel image forming method just described, this patent specification may be implemented in many other specific forms, as will be appreciated by those skilled in the relevant art(s), without departing from the spirit or scope of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
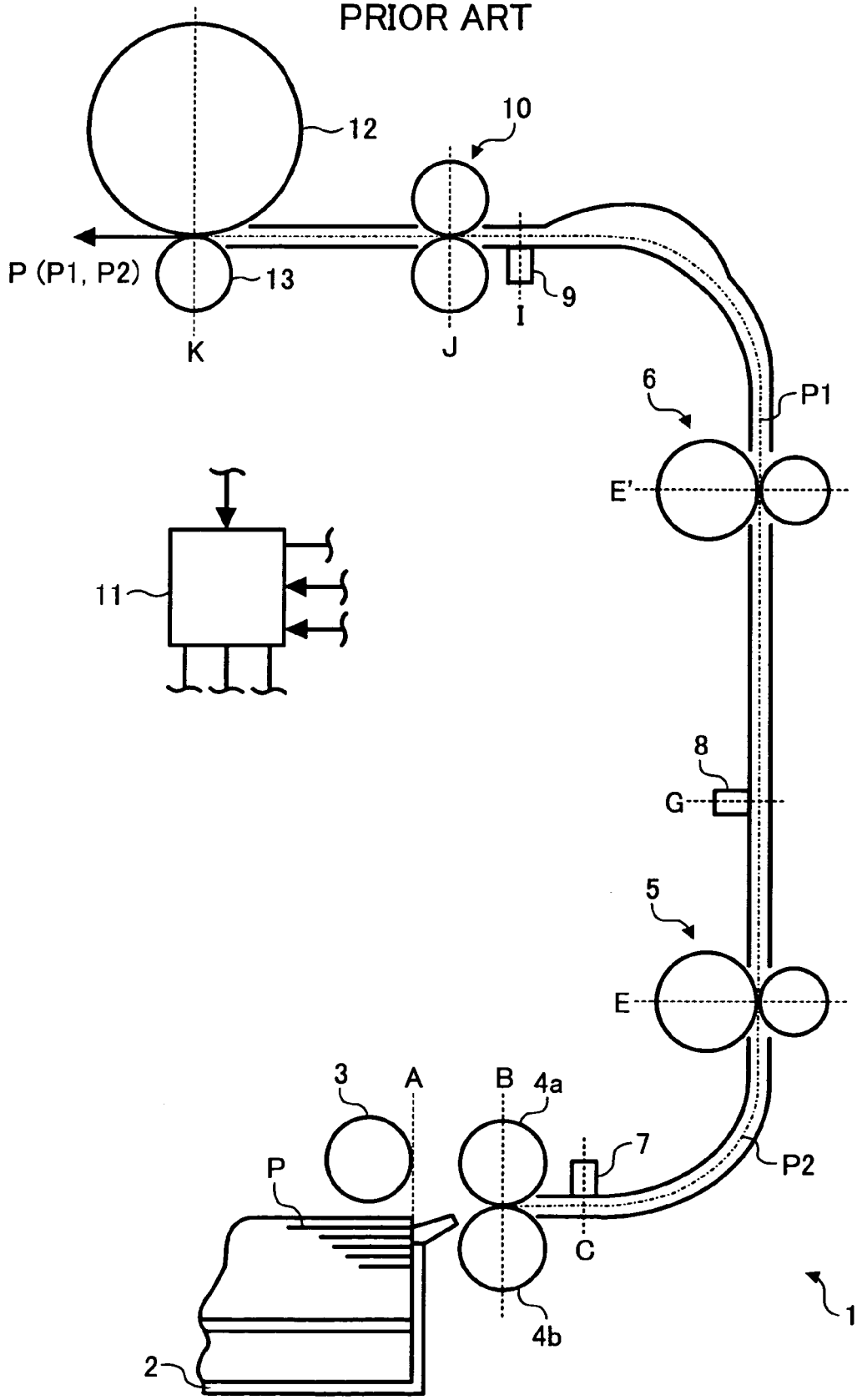
FIG. 1 PRIOR ART
FIG. 1 is a schematic diagram illustrating a known sheet transfer apparatus used in image forming apparatuses.

In describing preferred embodiments illustrated in the drawings, specific terminology is employed for the sake of clarity. However, the disclosure of this patent specification is not intended to be limited to the specific terminology selected and it is to be understood that each specific element includes all equivalents that operate in a similar manner. Referring now to the drawings, wherein like reference numerals designate identical or corresponding parts throughout the several views, particularly to FIG. 2, a description is made for an electrophotographic image forming apparatus 100 according to a preferred embodiment of the present invention.

The image forming apparatus 100 mainly includes a reading mechanism 15 provided with a scanner 15*a* and an ADF (Automatic Document Feeder) 15*b*, an image forming mechanism 20, and a sheet feeding apparatus 101. The image forming mechanism 20 includes a charger 21, an exposure device 22, a photoconductor 12, a developer 24, a transfer device 25, a fixing device 26, a pair of ejection rollers 27, a sheet ejection tray 28, and a cleaner 29.

Figure 2:
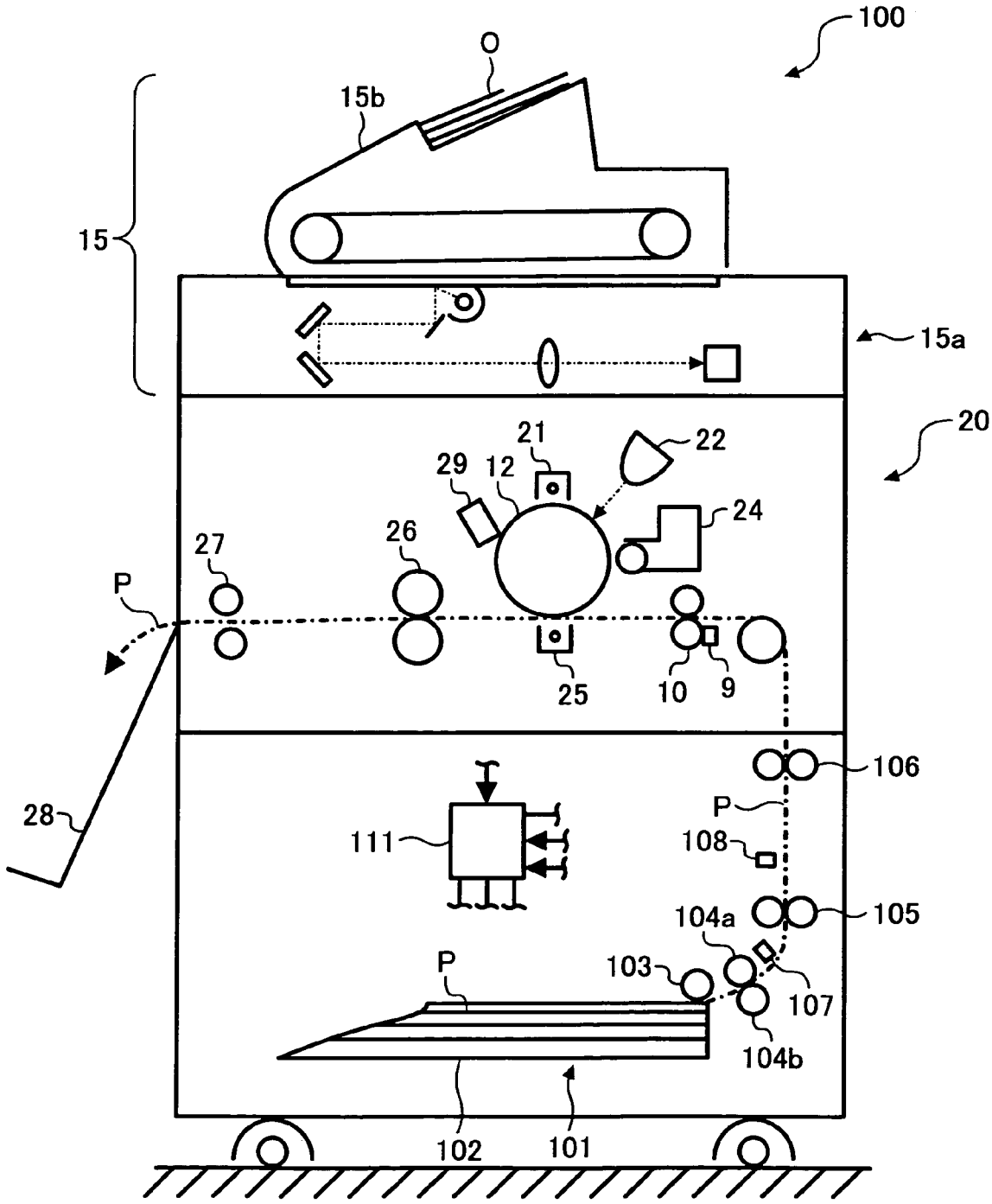
FIG. 2 is a schematic diagram illustrating an image forming apparatus according to an embodiment of the present invention.

The sheet transfer apparatus 101 has a structure substantially similar to the structure of the background sheet transfer apparatus 1 of FIG. 1, except for a transfer sensor 107 and a controller 111. Specifically, a sheet tray 102, a pick-up roller 103, a feed roller 104*a*, a reverse roller 104*b*, a first transfer roller 105, a second transfer roller 106, and a sensor 107 are all similar to the corresponding components of the background sheet transfer apparatus 1. The controller 111 and the transfer sensor 107 of FIG. 2 are different from the controller 11 and the transfer sensor 7 of FIG. 1, respectively, which will be described later referring to FIG. 3.

The scanner 15*a* optically reads image data from the original document O, placed on an exposure glass (not shown) or on the ADF 15*b* by a user. The exposure device 22 irradiates light to the photoconductor 12, that has been uniformly charged by the charger 21, according to the image data to form an electrostatic latent image on the photoconductor 12. The developer 24 develops the electrostatic latent image with toner to form a toner image on the photoconductor 12. The toner image is then transferred by the transfer device 25, which servers as the image transfer roller 13 of FIG. 1, onto the recording sheet P carried by the sheet transfer apparatus 101. The toner image transferred onto the recording sheet P is fixed with heat and pressure applied by the fixing device 26. The fixed toner image is conveyed through the pair of ejection rollers 27 to the sheet ejection tray 28. At the same time, the cleaner 29 removes toner remained on the surface of the photoconductor 12 to prepare for a next image forming process.

In operation, the sheet transfer apparatus 101 is similar to the background sheet transfer apparatus 1. However, instead of generating a sheet interval at position B where slippage is large, the sheet transfer apparatus 101 generates a sheet interval at a location where slippage is small, i.e., position G Therefore, the sheet transfer apparatus 101 can stably transfer recording sheets P even with short sheet intervals.

The image forming apparatus further includes an operational panel (not shown) including various keys for allowing a user to input instructions and a display (not shown) for indicating various kinds of information.

In addition, the image forming apparatus 100 may further include optional equipment such as, for example, a duplex print unit (not shown) for printing an image on the reverse side of the recording sheet P, or a large capacity sheet tray (not shown). Furthermore, in addition to the sheet tray 1, the image forming apparatus 100 may include one or more sheet trays, each containing a stack of recording sheets P.

Figure 3:
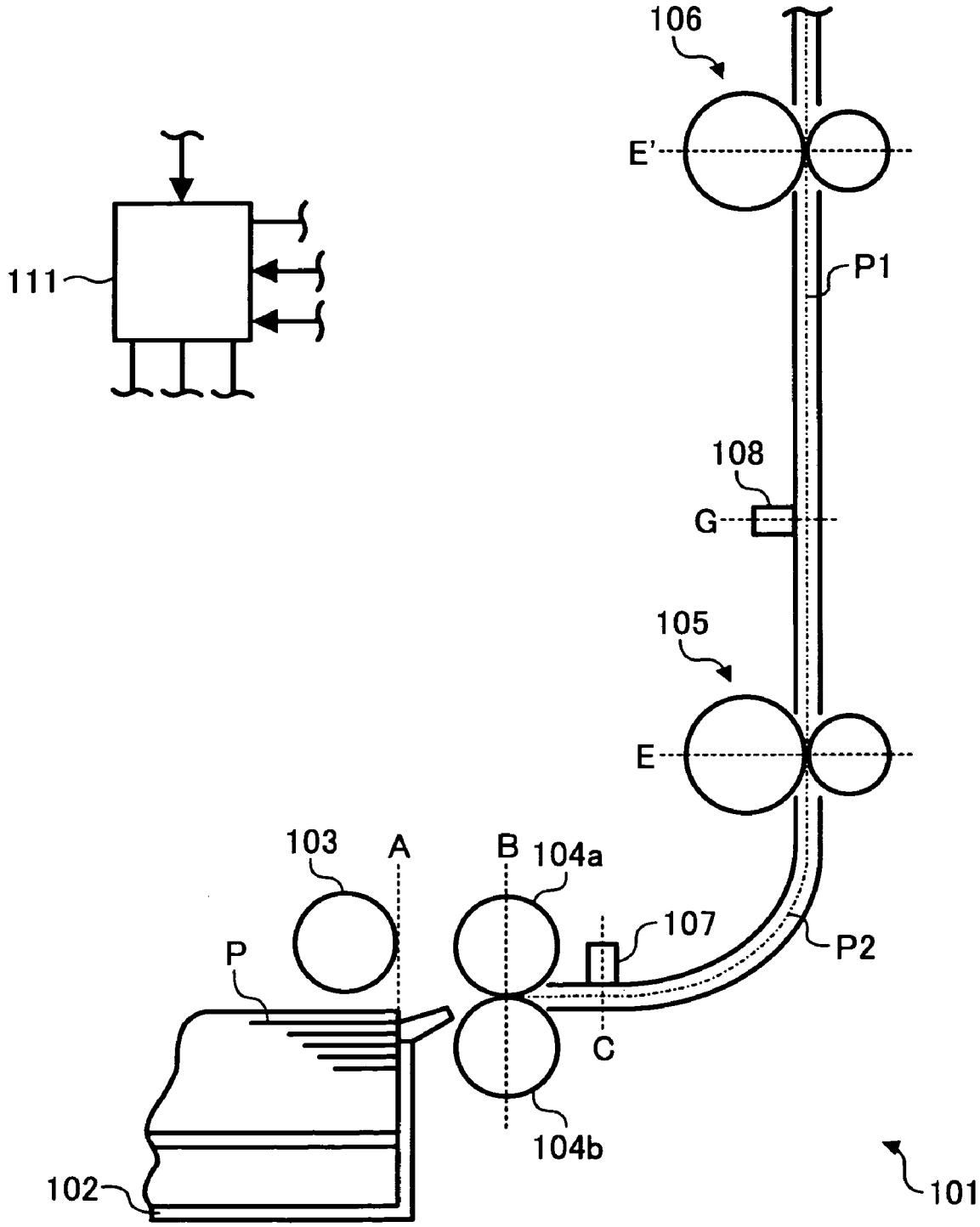
FIG. 3 is a schematic diagram illustrating a sheet transfer apparatus included in the image forming apparatus of FIG. 2.

FIG. 3 illustrates the structure of the sheet transfer apparatus 101 in more details. The transfer sensor 108 of FIG. 3 is a reflective sensor having a structure similar to the structure of the transfer sensor 8 of FIG. 1. The controller 111 of FIG. 3 is similar in structure to the controller 11 of FIG. 1, except for a program installed therein for controlling the operation of the sheet transfer apparatus 101. The controller 111 controls the operation of the first and second transfer rollers through the transfer roller driving motor based on the output from the transfer sensor 108 or based on the program installed therein.

Referring now to FIGS. 3, 4, and 5A to 5D, the operation of the sheet transfer apparatus 101 is explained in more details. The sheet transfer apparatus 101 continuously feeds the recording sheets P, however, for the sake of simplicity, only a preceding recording sheet P1 and a succeeding recording sheet P2 are described herein.

Figure 4A:
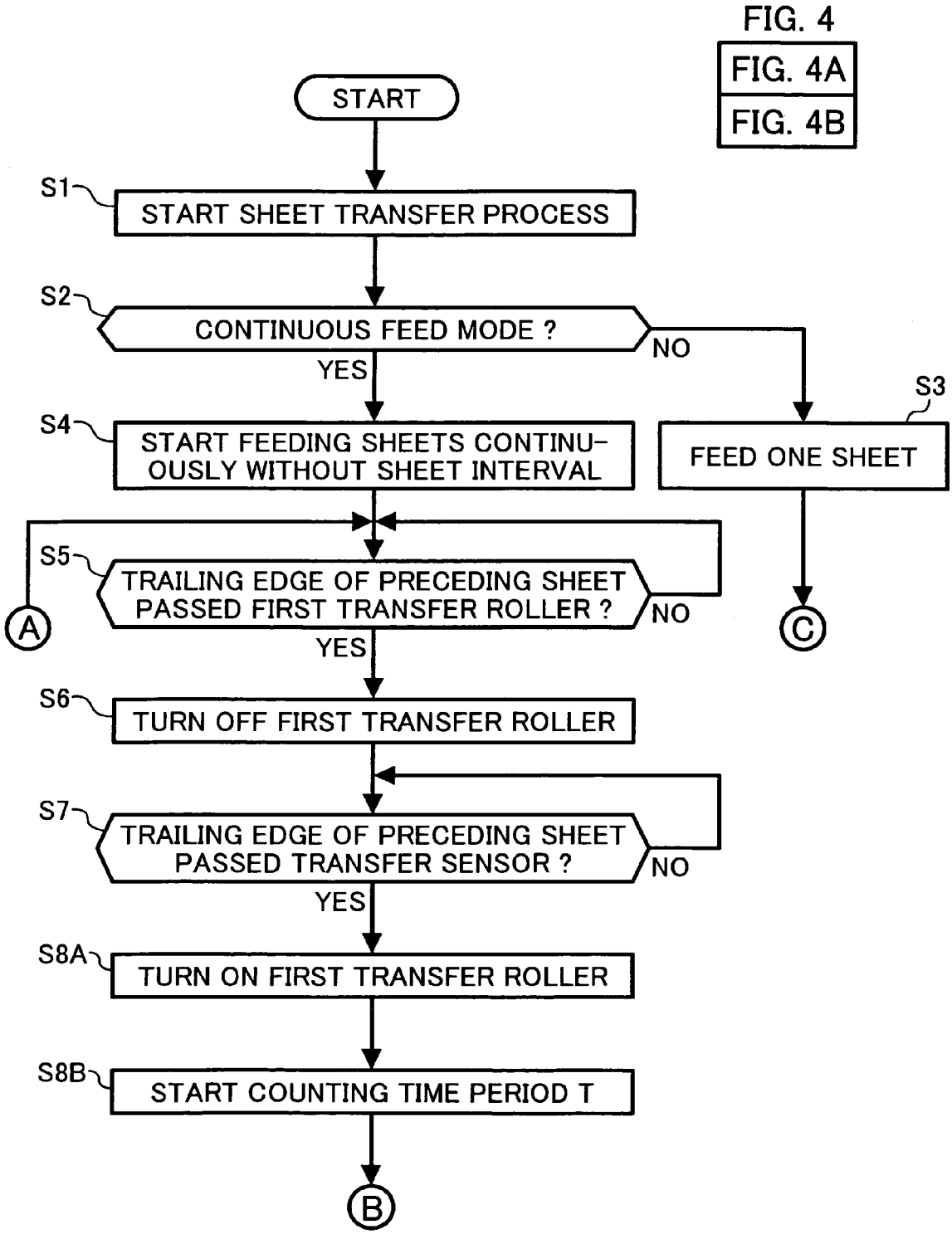
FIG. 4 is a flowchart illustrating a sheet transfer operation performed by the sheet transfer apparatus of FIG. 2.
Figure 4B:
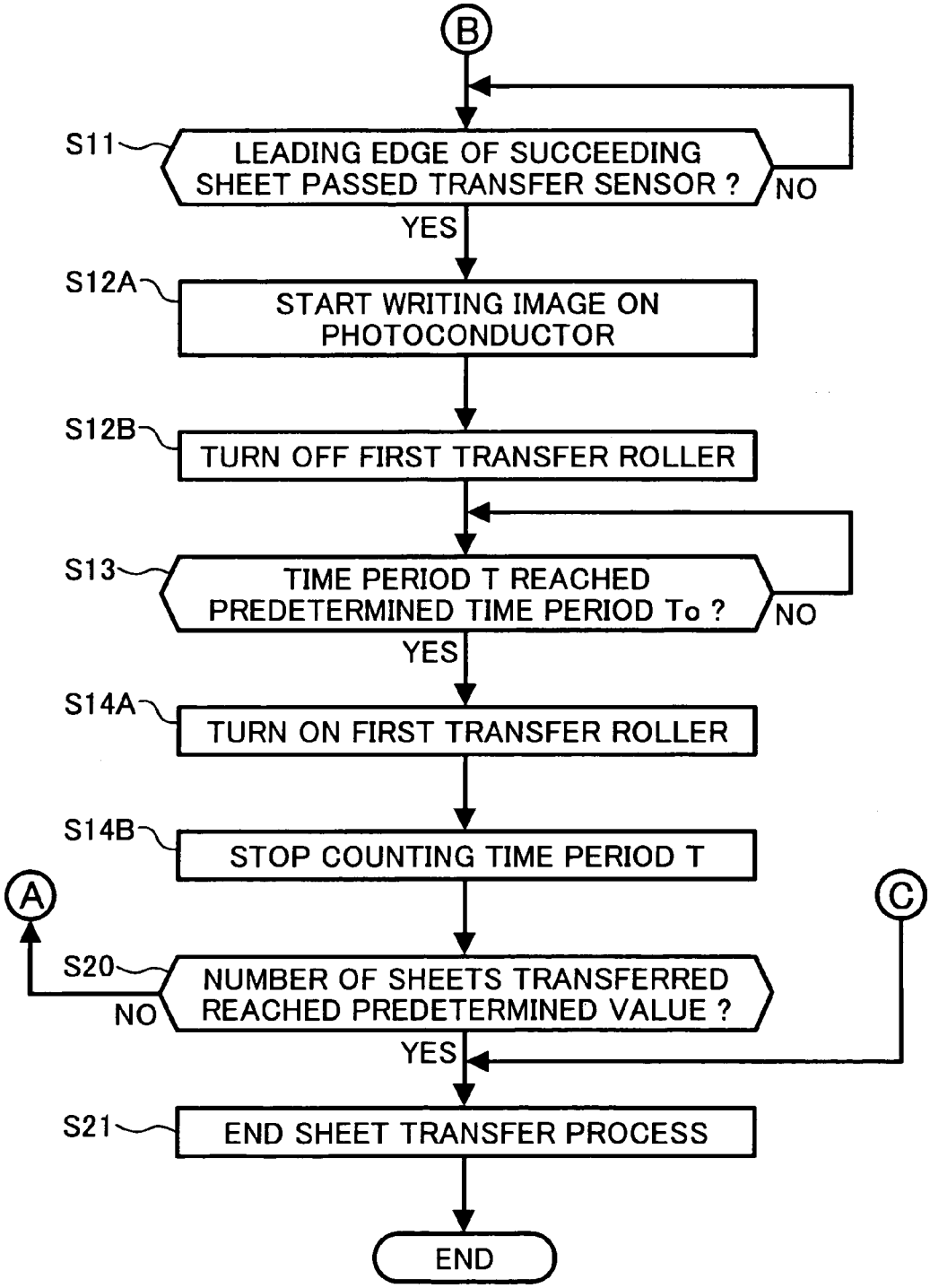

Referring to FIG. 4, when the illustrated process starts, in step S1, the controller 111 receives an instruction from the user to start the sheet transfer process. In step S2, the controller 111 determines whether a request has been received to continuously feed the recording sheets P (i.e., continuous feed mode) or otherwise to feed one recording sheet P. If the answer in step S2 is no, in step S3 the sheet transfer apparatus 101 feeds one recording sheet P, and the process ends.

If the answer in step S2 is yes, in step S4, the pick-up roller 103 starts feeding the preceding sheet P1 and the succeeding sheet P2 continuously without generating a sheet interval therebetween.

Once the leading edge of the proceeding sheet P1 reaches position C, the driving of pick-up roller 3 is stopped. The preceding sheet P1 is then transferred by the transfer power of the feed roller 4*a* from position C to position E.

Next, step S5 determines whether the trailing edge of the preceding sheet P1 has passed position E where the first transfer roller 105 is provided. If the answer is no, the process repeats step S5. If the answer is yes, that is, the trailing edge of the preceding sheet P1 has reached position E as illustrated in FIG. 5(A), the process moves to step S6. At this time, the determination is made by the controller 111 to change the operation of the rollers based on the size of the recording sheet P and the rotational speed of each roller, which have been previously programmed in the controller 111 or detected by the sheet tray 1.

In step S6, the controller 111 stops the transfer roller driving motor to stop the rotation of the first transfer roller 105. Thus, the proceeding sheet P1 is further transferred by the second transfer roller 106, while the leading edge of the succeeding sheet P2 remains at position E.

Subsequently, in step S7, the controller 111 determines whether the trailing edge of the preceding sheet P1 has passed position G where the transfer sensor 108 is provided in a similar manner as previously described in step S5 based on the output from the transfer sensor 108. If the answer is no, the process repeats step S7. If the answer is yes, that is, the trailing edge of the preceding sheet P1 has passed position C the process continues to step S8A and step S8B.

In step S8A, the controller 111 restarts the transfer roller driving motor so as to rotate the first transfer roller 105. As a result, the preceding sheet P1 and the succeeding sheet P2 are transferred while keeping a first sheet interval D1 as illustrated in FIG. 5(B). The first sheet interval D1 is determined based on the distance between positions E and G Step S8B starts counting a time period T.

In Step S11, the controller 111 determines whether the leading edge of the succeeding sheet P2 has reached position G in a similar manner as described in step S5 based on the output from the transfer sensor 108. If the answer is no, the process repeats step S11. If the answer is yes, that is, the leading edge of the succeeding sheet P2 has reached position G as illustrated in FIG. 5(C), the process moves to step S12A and step S12B.

In step S12A, the controller 111 instructs the image forming apparatus 100 to start operation of the photoconductor 12.

At the same time, in step S12B, the first transfer roller 105 is stopped. Thus, the leading edge of the succeeding sheet P2 remains at position G while the preceding sheet P1 is further transferred by the second transfer roller 106. Thus, the sheet interval between the preceding sheet P1 and succeeding sheet P2 is further increased.

Subsequently, step S13 determines whether the time period T has reached a predetermined time period T0. If the answer is no, the process repeats step S13. If the answer is yes, the process first moves to step S14A, which restarts the rotation of the first transfer roller 5, and to step S14B, which stops the counting of the time period T. In this example, as illustrated in FIG. 5(D), the predetermined time period T0 determines a second sheet interval D2 to be added first (sheet interval D1) to obtain a desired overall sheet interval L. More specifically, the controller 111 previously sets the time period T0 such that a desired second sheet interval D2, or a desired overall sheet interval L, is generated, which can properly prevent the sheets from superimposing each other, or any other failure that may be caused during skew or registration corrections.

Step S20 then determines whether the number of transferred sheets reaches the predetermined value previously set by the user. If the answer is no, the process goes back to step S5 to repeat steps S5 to S20. If the answer is yes, the process moves to step S21, completing the sheet transfer process.

Figure 6:
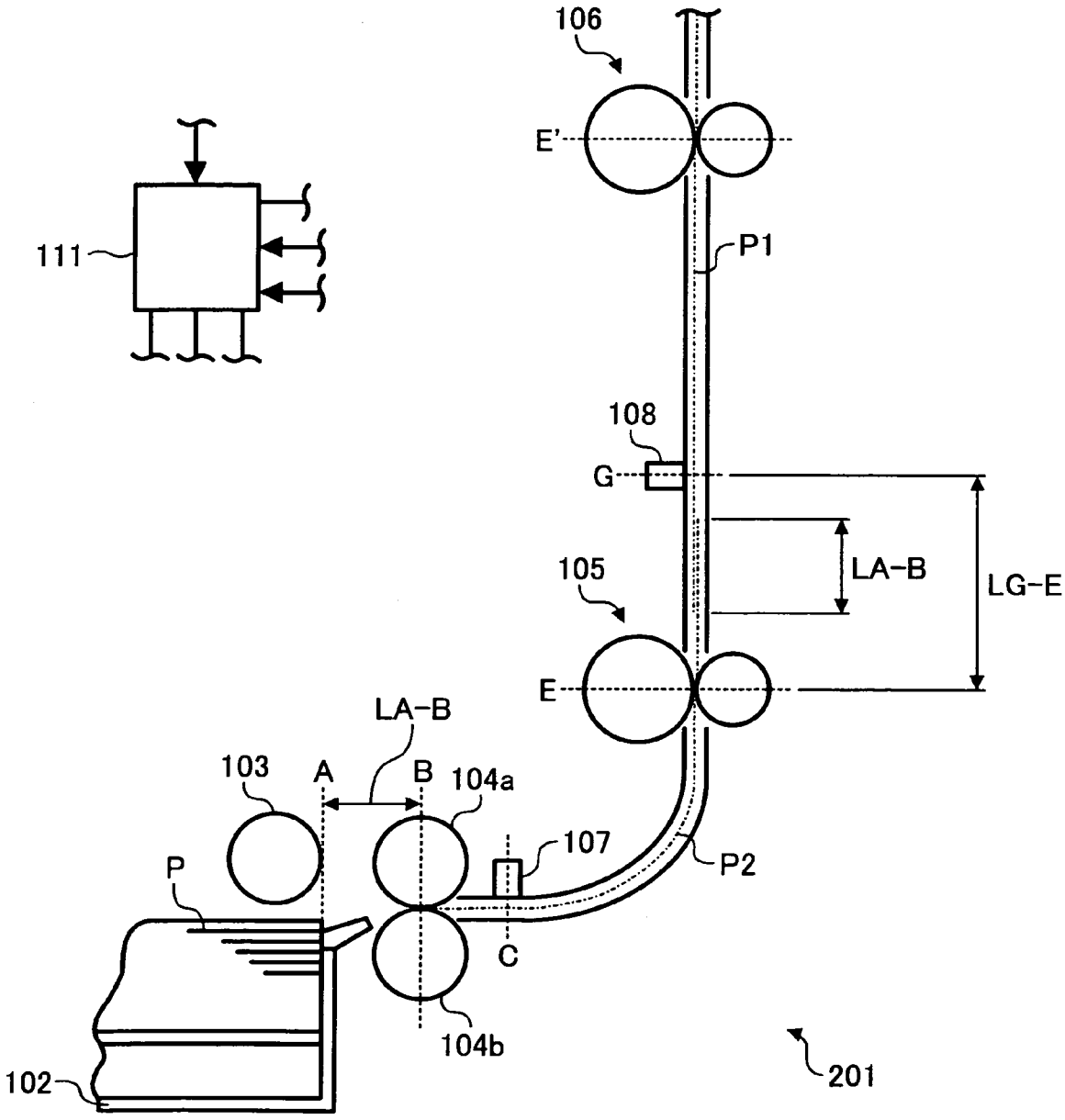
FIG. 6 is a schematic diagram illustrating a sheet transfer apparatus according to another embodiment of the present invention.

Next, with reference to FIG. 6, a sheet transfer apparatus 201 according to another embodiment of the present invention is explained. As shown in FIG. 6, the sheet transfer apparatus 201 is similar in structure to the sheet transfer apparatus 101 of FIG. 3, except that position G is located at a distance LG-E downstream from position E, that is greater than the distance LA-B between positions A and B.

As described earlier, the recording sheet P is first placed on an initial position between positions A and B. Because the pick-up roller 103 successively feeds the preceding and succeeding sheets P1 and P2 without generating a sheet interval, the sheets P1 and P2 may partially superimpose each other over an area having a maximum length of LA-B in the transfer direction. By providing the first transfer sensor 108 at a distance LG-E from position E, the trailing edge of the preceding sheet P1 can be effectively detected at position G even when superimposing occurs.

Specifically, in this example, the transfer sensor 108 is provided such that distance between the positions A and G is 124.3 mm, while the first transfer roller 105 is provided such that the distance between positions A and E is 84.3 mm. Thus, the distance LG-E is 40 mm, which is greater than the distance LA-B of 24.5 mm.

Figure 7:
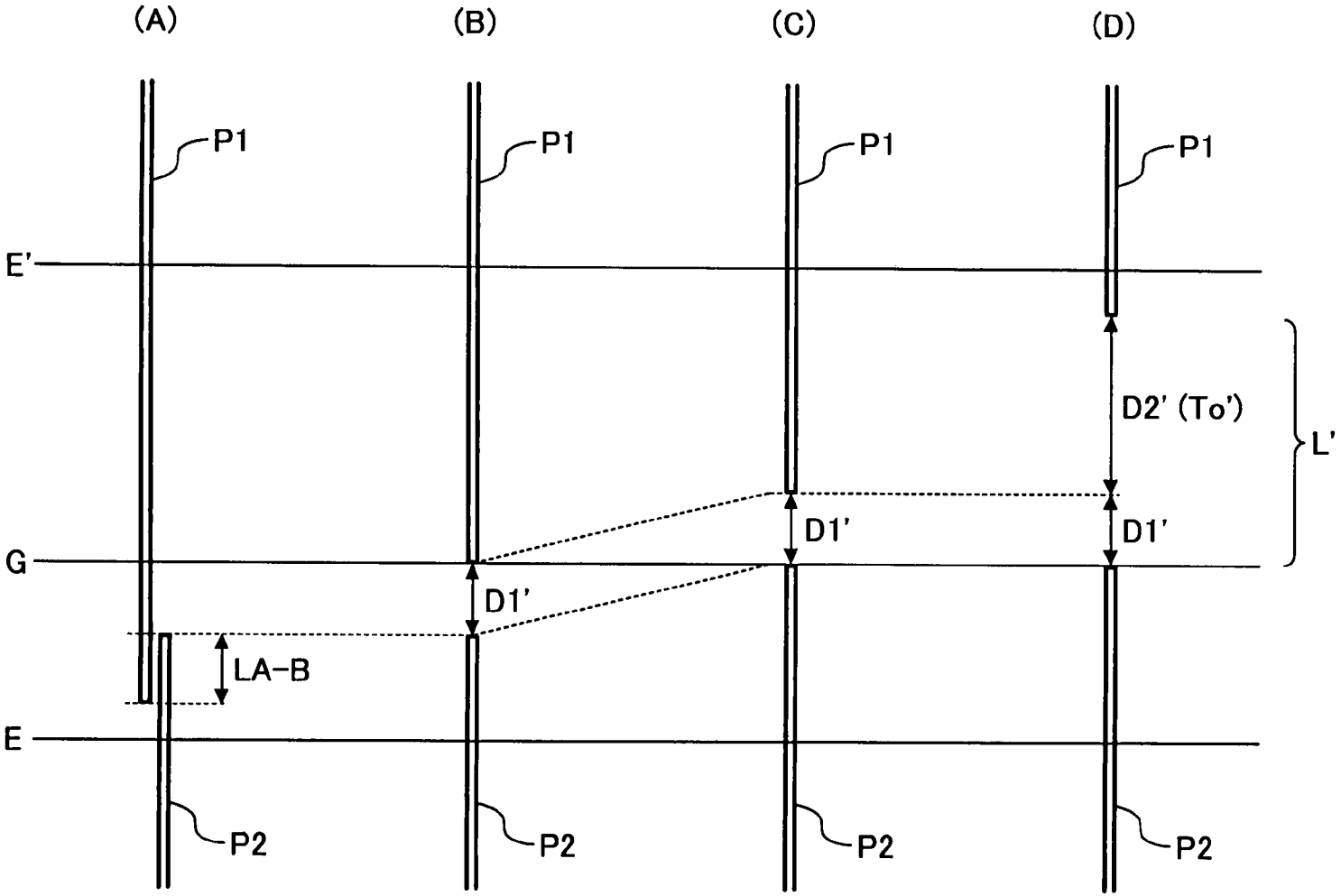
FIGS. 7A to 7D are illustrations of various relative positions of preceding and succeeding sheets, transferred by the sheet transfer apparatus of FIG. 6.

FIGS. 7(A) to 7(D) illustrate the operation of the sheet transfer apparatus 201 when the preceding sheet P1 partially superimposes the succeeding sheet P2. As illustrated in FIG. 7(A), the superimposed area can be any value equal to or less than the distance LA-B. In this example, however, the superimposed area is assumed to have a maximum length of 24.5 mm.

Figure 5:
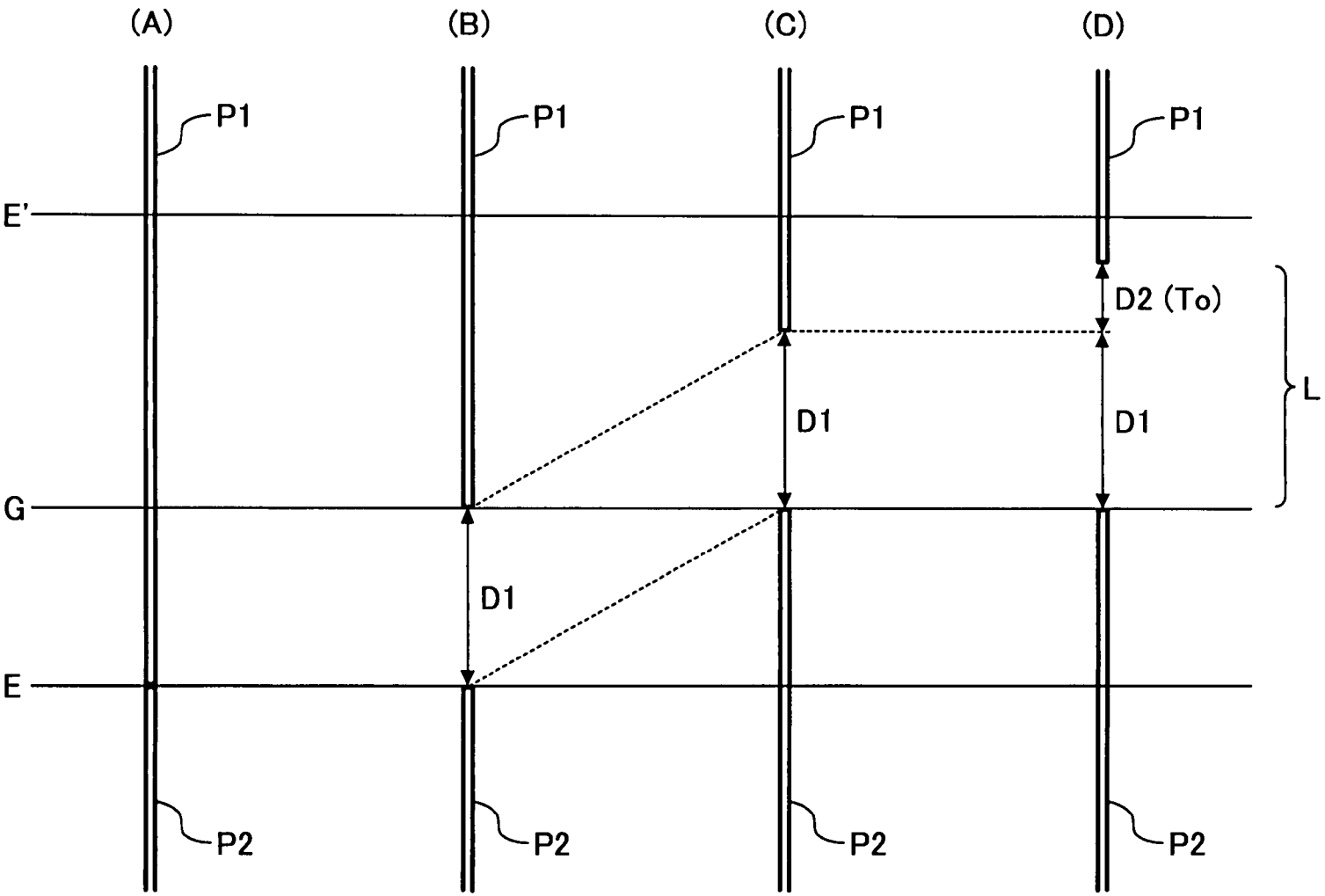
FIGS. 5A to 5D are illustrations of various relative positions of preceding and succeeding sheets, transferred by the sheet transfer apparatus of FIG. 2.

The operation of the sheet transfer apparatus 201 is similar to the operation of the sheet transfer apparatus 101 illustrated in FIG. 5, except that sheet intervals generated in the operation have different values due to sheet superimposition.

Specifically, in FIG. 7(A), the preceding sheet PI and the succeeding sheet P2 superimpose one above the other over the length of 24.5 mm. The sheet transfer apparatus 201 of FIG. 7(B) generates a first sheet interval D1', which is smaller by approximately 24.5 mm than the first sheet interval D1 of FIG. 5(B). For example, if the first sheet interval D1 is 30 mm, the first sheet interval D1' is 5.5 mm.

After transferring the preceding sheet P1 and the succeeding sheet P2 while keeping the first sheet interval D1' as illustrated in FIG. 7(C), the sheet transfer apparatus 201 of FIG. 7(D) generates a second sheet interval D2' to be added to the first sheet interval D1'. As a result, a desired overall sheet interval L' is generated.

In this example, in order for the overall sheet interval L' to be substantially equal to the overall sheet interval L, the controller 111 of FIG. 6 sets a predetermined time period T0' at a value larger than the predetermined time period T0 taking into consideration the sheet area being superimposed. For example, if the overall sheet interval L of FIG. 5(D) is 40 mm, the second sheet interval of 34.5 mm is generated, which is 24.5 mm larger than the second sheet interval D2 of FIG. 5(D).

In this way, the sheet interval variation generated due to the variation in initial position of the recoding sheet P can be effectively suppressed.

Figure 8:
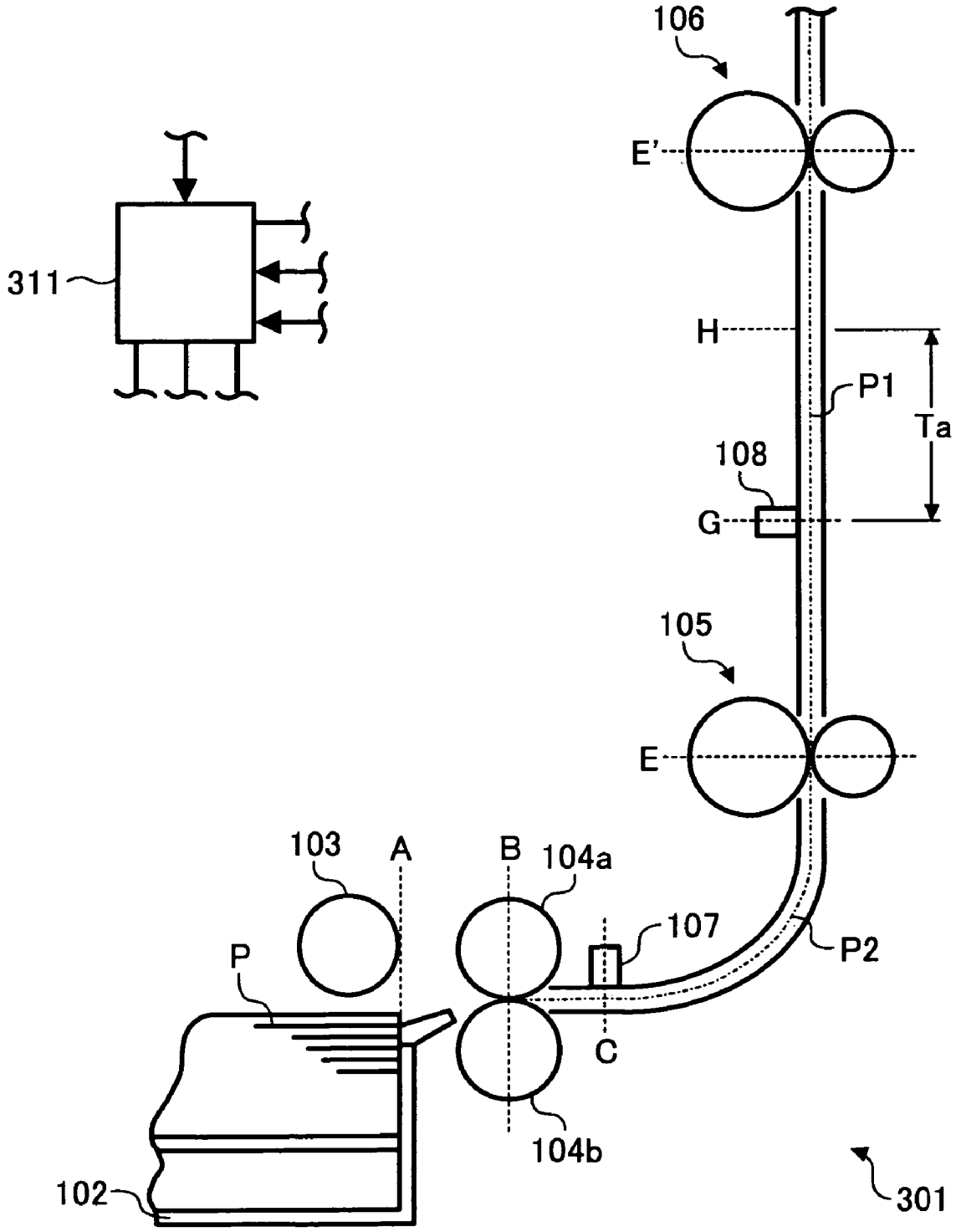
FIG. 8 is a schematic diagram illustrating a sheet transfer apparatus according to another embodiment of the present invention.

Next, referring to FIG. 8, a sheet transfer apparatus 301 according to another embodiment of the present invention is explained. The sheet transfer apparatus 301 of FIG. 8 is similar to the sheet transfer apparatus 101 of FIG. 3, except for a controller 311, which stores a program different from that of the controller 111. In the sheet transfer apparatus 301, the controller 311 additionally performs a function for increasing the rotational speed of the first transfer roller 105 in a predetermined interval between position E and position H. In this example, the position H may be anywhere between positions G and E', but is preferably set so as to provide a desired sheet interval between the preceding sheet P1 and the succeeding sheet P2.

The predetermined interval in which the first transfer roller 105 is driven at a faster speed is previously programmed in the controller 311 and is equal to either the interval between positions E and Q positions G and H, or positions E and H.

Figure 9A:
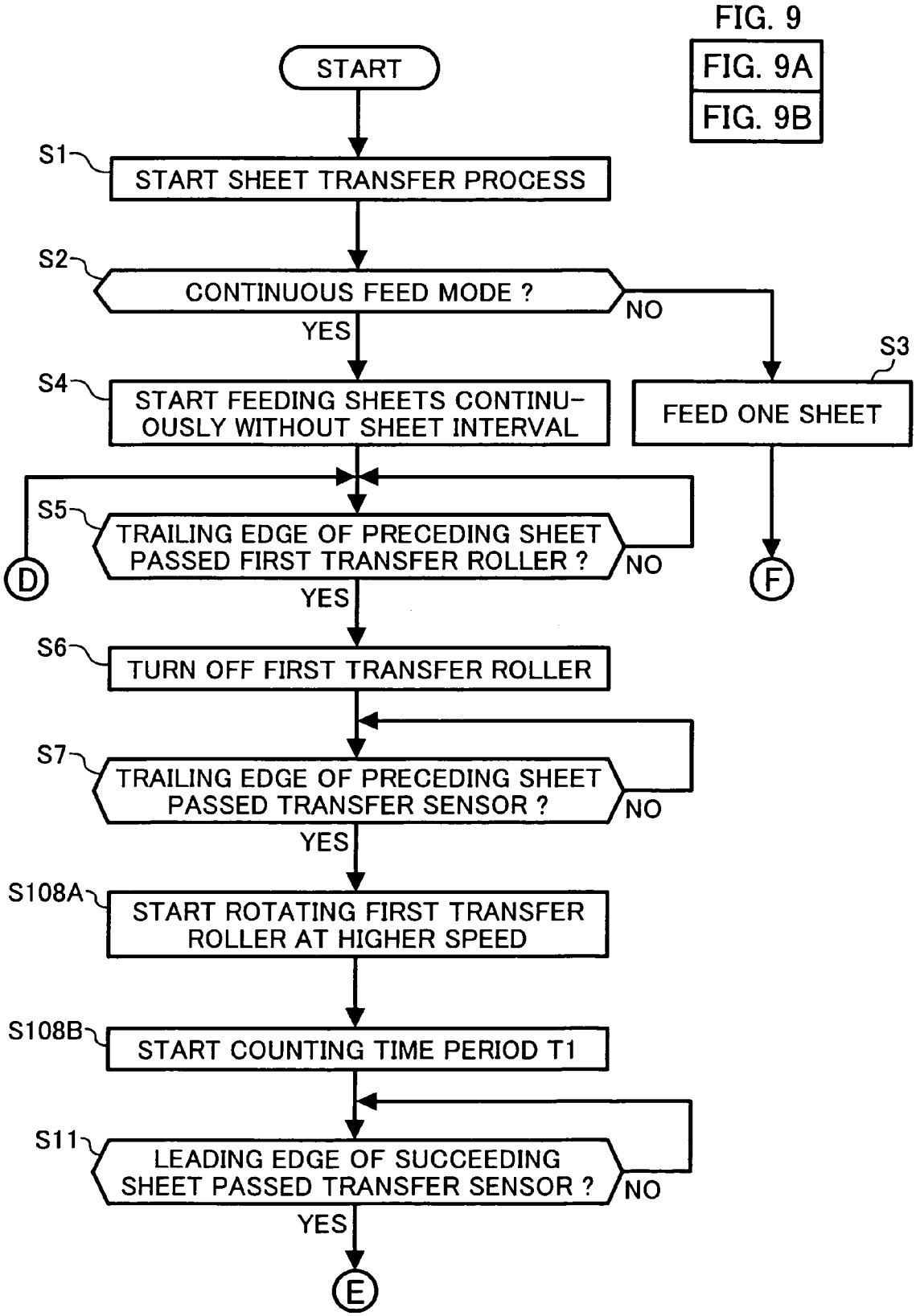
FIG. 9 is a flowchart illustrating a sheet transfer operation performed by the sheet transfer apparatus of FIG. 8.
Figure 9B:
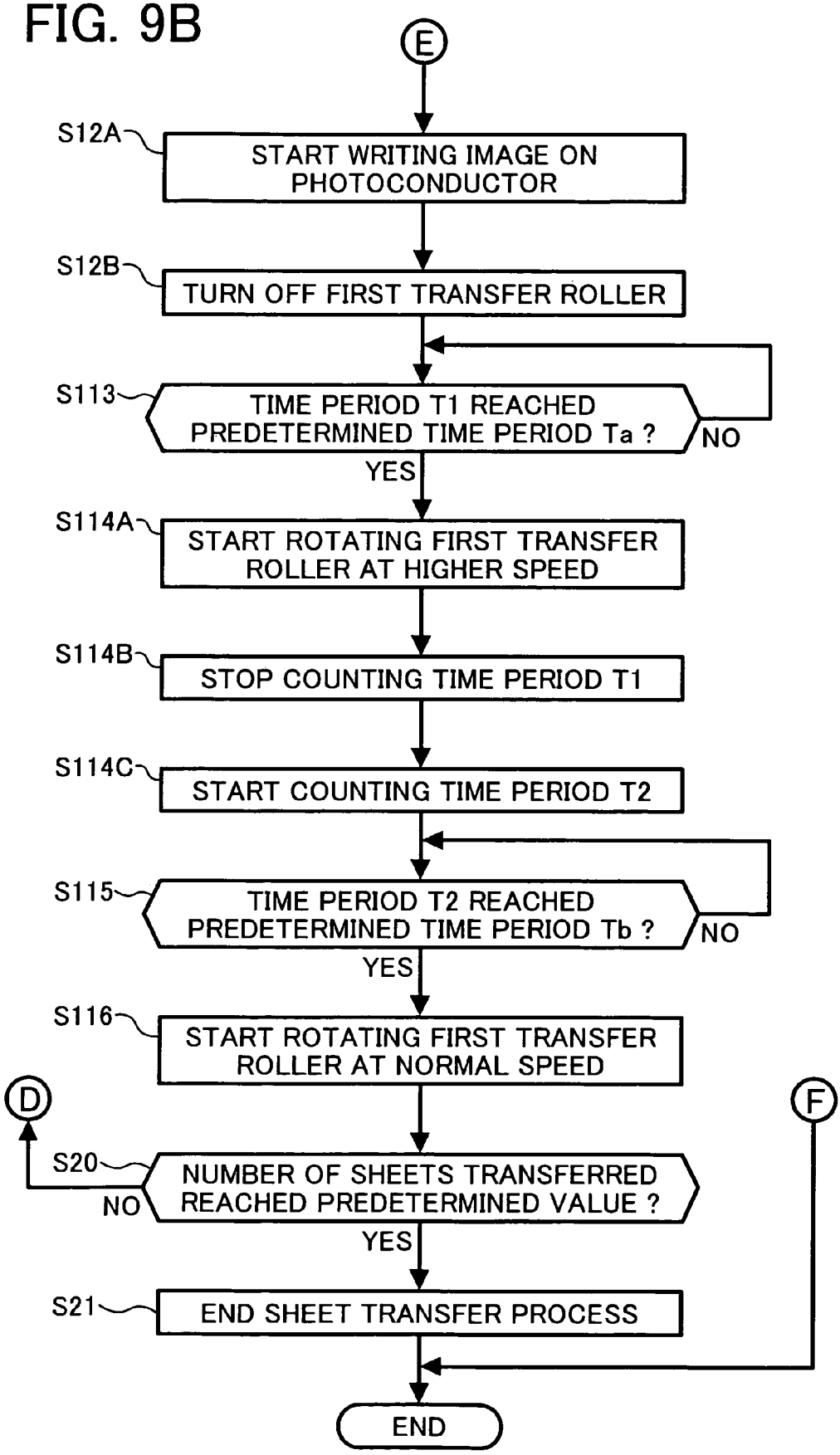

FIG. 9 illustrates an exemplary operation of the sheet transfer apparatus 301 when the first transfer roller 5 is driven at a faster speed between positions E and H. In this case, the sheet transfer apparatus 301 operates in a similar manner as the sheet transfer apparatus 101 operates, at least for the process described in steps S1 to S7, S11 to S12B, and steps S20 and 21.

When step S7 determines that the trailing edge of the preceding sheet P1 has passed position G of the transfer sensor 108, that is, when the answer in step S7 is yes, the process moves to step S108A and step S108B.

Step S108A starts rotating the first transfer roller 105 at a faster rotational speed V2, which is faster than the normal rotational speed V1 used in the preceding steps. Thus, the succeeding sheet P2 moves faster than the preceding sheet P1, while reducing a sheet interval that has been generated in step S6. Once the speed of the transfer roller 105 is changed, step S108B starts counting a time period T1.

Next, step S11 determines whether the leading edge of the succeeding sheet has reached the transfer sensor 108. If the answer is no, the process repeats step S11. If the answer is yes, the process moves to step S12A which starts optical writing, and to step S12B which stops the rotation of the first transfer roller 105.

Subsequently, step S113 determines whether the time period T1 has reached a predetermined time period Ta. If the answer is no, the process repeats step S113. If the answer is yes, the process moves to step S114A, S114B and S114C.

Step S114A starts rotating the first transfer roller 105 at the faster speed V2, step S114B stops counting the time period T1, and step S114C starts counting a time period T2.

Step S115 determines whether the time period T2 has reached a predetermined time period Th. When the answer is no, the process repeats step S115. When the answer is yes, the process moves to step S116, which reduces the rotational speed of the first transfer roller 105 from the faster speed V2 to the normal speed V1. Therefore, the preceding sheet P1 and the succeeding sheet P2 are transferred with a desired sheet interval.

In this example, the predetermined time periods Ta and Tb are previously programmed in the controller 311 so as to generate a desired sheet interval between the preceding sheet P1 and the succeeding sheet P2. However, instead of using the time periods Ta and Th, the sheet interval can be controlled based on the amount of rotation of the motor driving the transfer roller 105, the amount of feed of the first transfer roller 105, or the number of pulses provided by a stepping motor (not shown).

In this example, the rotational speed of the first transfer roller 301 is increased from position E to E', however, it may be increased only from positions E to G, or from positions G to E'.

Figure 10:
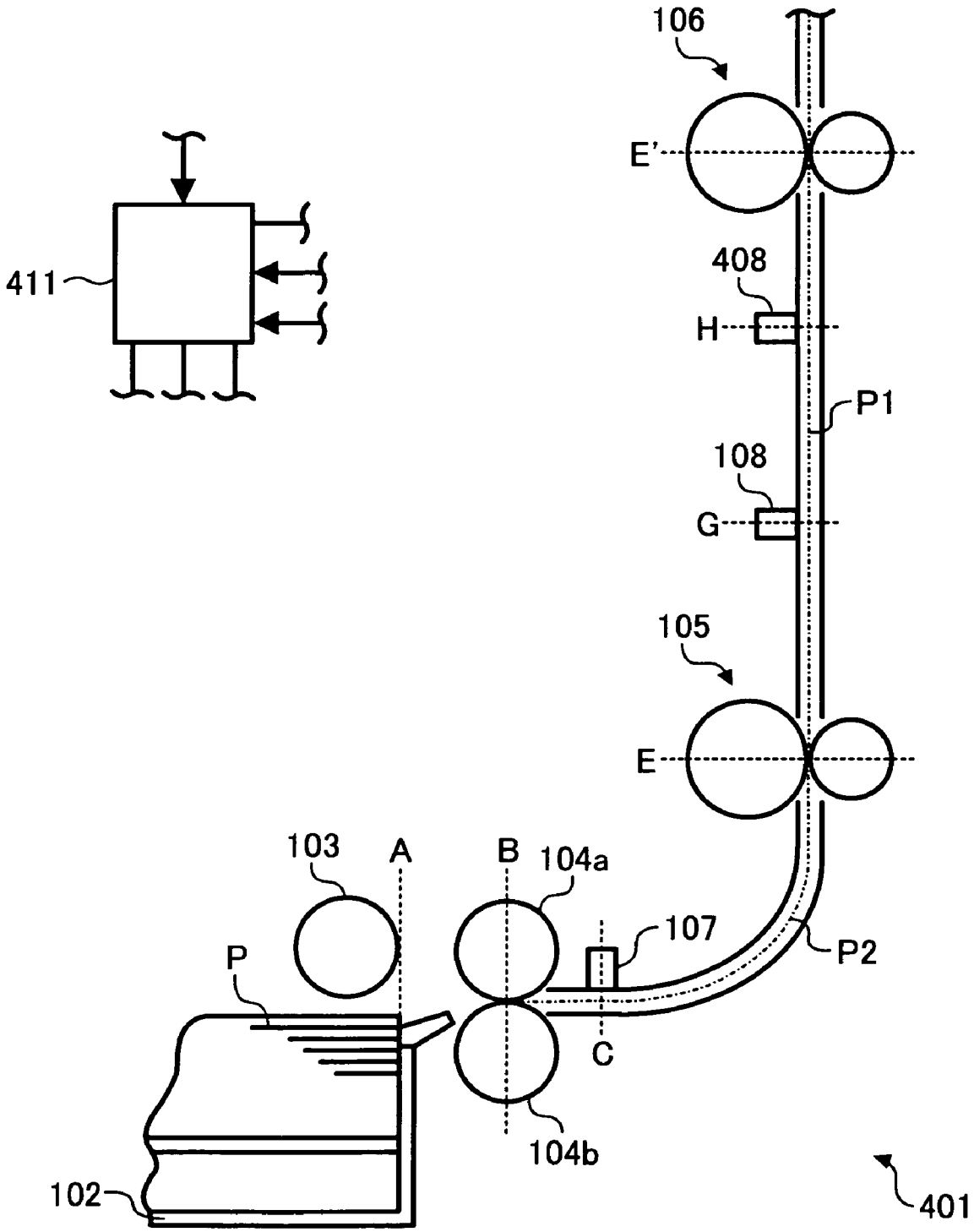
FIG. 10 is a schematic diagram illustrating a sheet transfer apparatus according to another embodiment of the present invention.

Next, referring to FIG. 10, a sheet transfer apparatus 401 according to another embodiment of the present invention is explained. The sheet transfer apparatus 401 is similar to the sheet transfer apparatus 301 of FIG. 8 except for a controller 411, and a downstream transfer sensor 408 provided at position H.

The downstream transfer sensor 408 measures an actual sheet interval between the preceding sheet P1 and the succeeding sheet P2. The controller 411 is similar to the controller 301, except for a program stored therein. In this example, the controller 411 calculates a predetermined time period Tb based on the actual sheet interval measured by the downstream transfer sensor 408.

Figures 11, 11A:
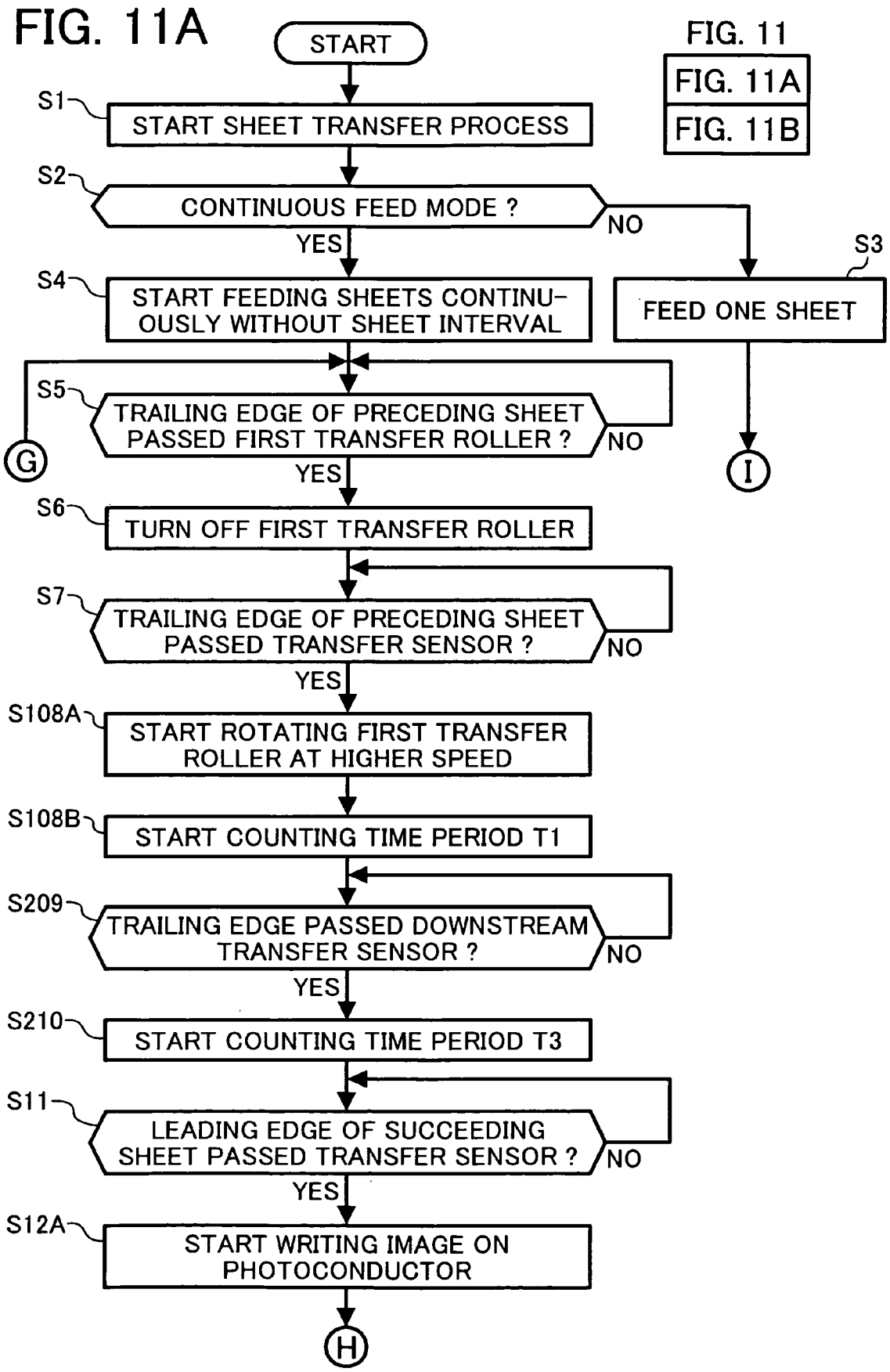
FIG. 11 is a flowchart illustrating a sheet transfer operation performed by the sheet transfer apparatus of FIG. 10.
Figure 11B:
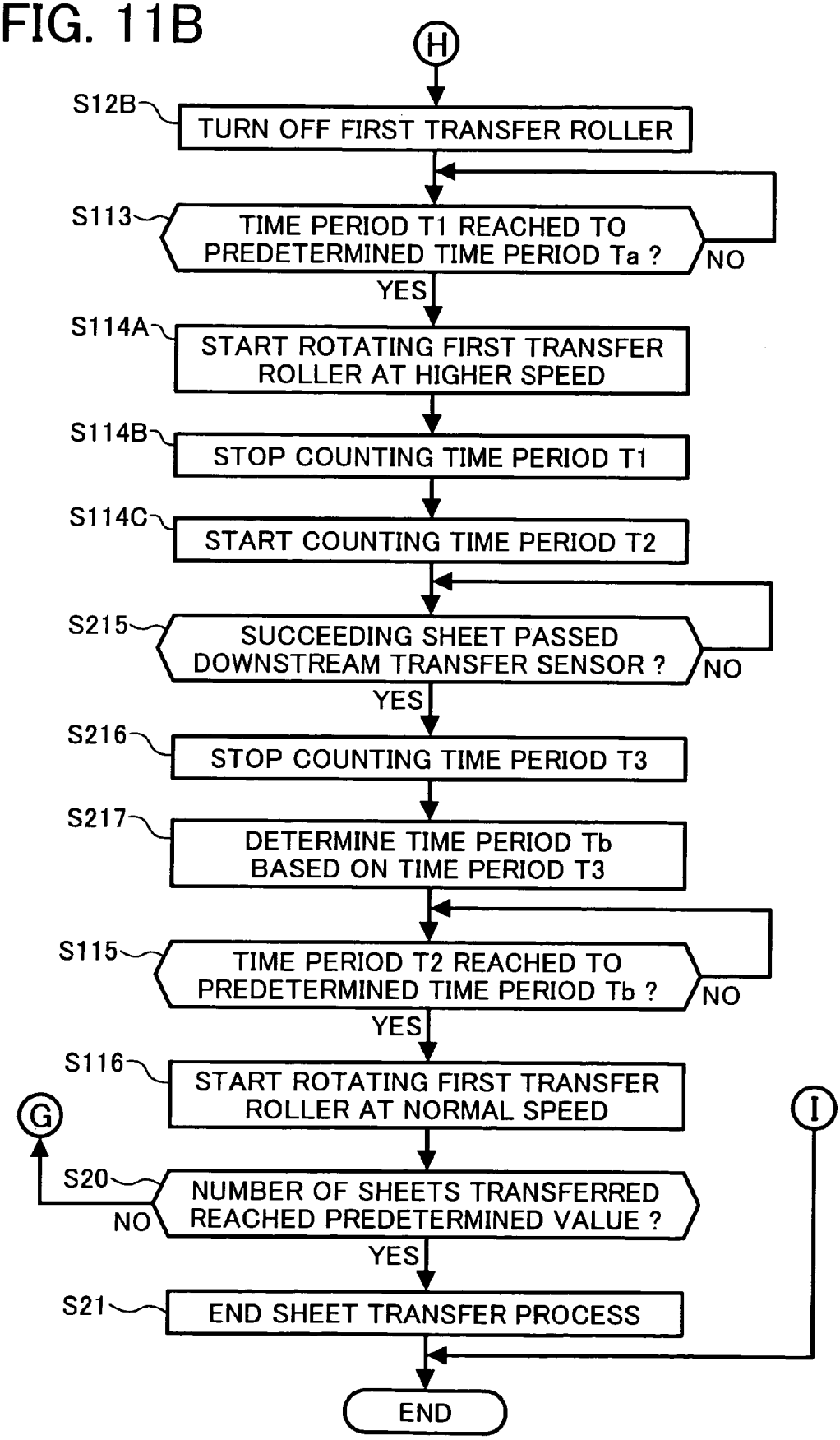

As illustrated in FIG. 11, the operation of the sheet transfer apparatus 401 is similar to the operation of the sheet transfer apparatus 301 of FIG. 9, except for the additional steps S209, S210, S215, S216 and S217.

Step S209 determines whether the trailing edge of the succeeding sheet P1 has passed position H. If the answer is no, the process repeats step S209. If the answer is yes, the process moves to step S210, which starts counting a time period T3.

Subsequently, after step S114C, step S21 5 determines whether the leading edge of the succeeding sheet has reached position H. If the answer is no, the process repeats step S215. If the answer is yes, the process moves to step S216, which stops counting the time period T3.

In this example, the time period T3 corresponds to a sheet interval between the preceding sheet P1 and the succeeding sheet P2, and is measured from when the trailing edge of the preceding sheet P1 passes the downstream transfer sensor 408, as illustrated in step S210, to when the leading edge of the succeeding sheet P2 reaches the downstream transfer sensor 408 as illustrated in step S216.

Next, in step S217, the controller 411 determines the time period Tb based on the time period T3, for example, by using the following equation:

$$Tb=(T3\times V1-L)/(V2-V1)+A/V2,$$

where V1 represents the normal rotational speed of the first transfer roller 105, V2 represents the faster rotational speed of the first transfer roller 105, L represents a desired sheet interval, and A represents the distance between the transfer sensor 108 and the downstream transfer sensor 408.

For example, if T3, V1, L, V2, V1, and A are 63.3 ms, 362 mm/s, 15 mm, 500 mm/s, 362 mm/s, and 10 mm, respectively, Tb is 77.4 ms.

Therefore, the time period Tb can be effectively determined so as to obtain the desired sheet interval even when the time period T3 varies, that is, even when the sheet interval variation occurs. For example, when the time period T3 is small, the controller 411 sets a shorter time period Tb. When the time period T3 is large, the controller 411 sets a longer time period Tb.

In this example, the rotational speed of the first transfer roller 401 is increased from positions E to E', however, it may be increased only from positions E to G, or from positions G to E'.

Figure 12:
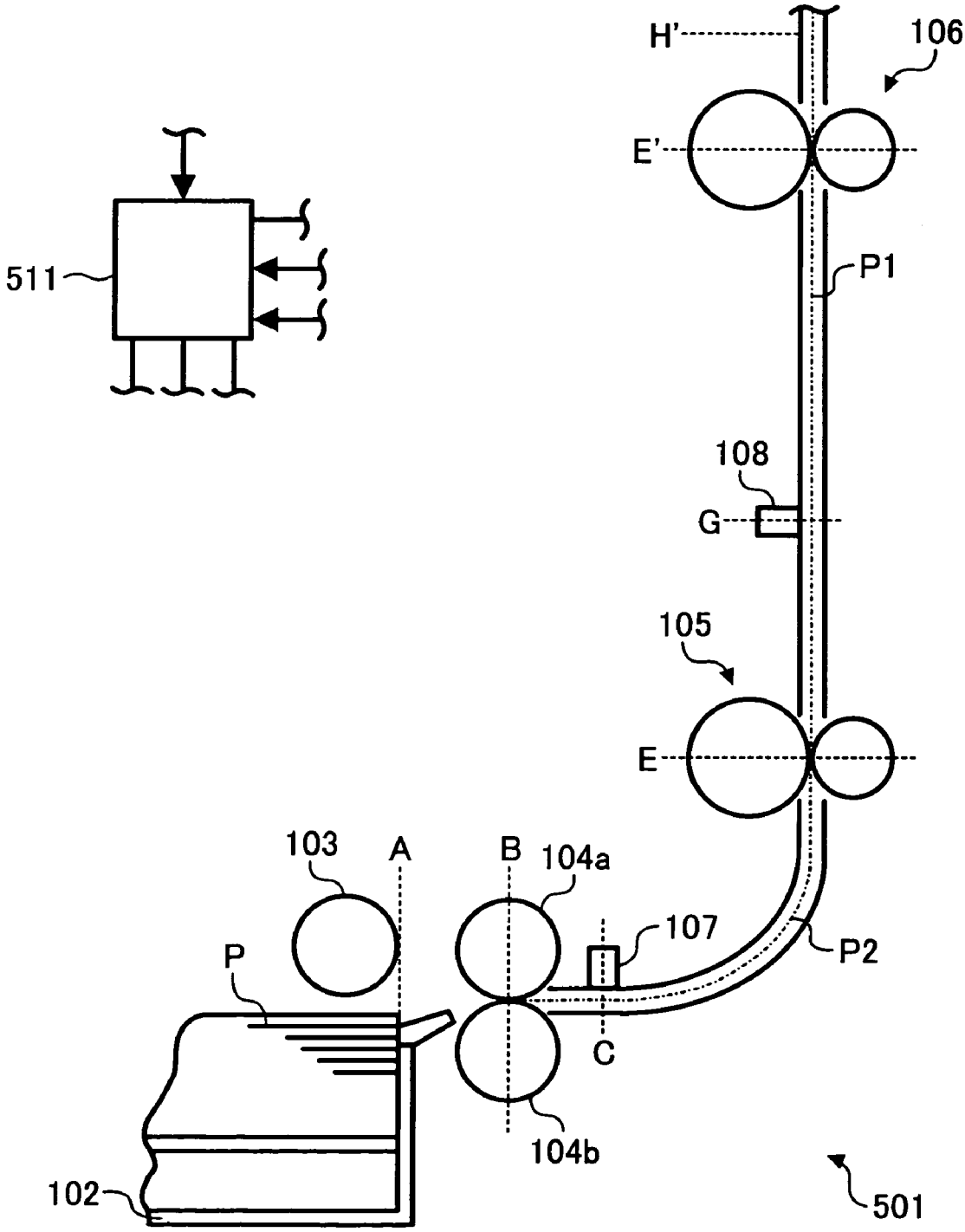
FIG. 12 is a schematic diagram illustrating a sheet transfer apparatus according to another embodiment of the present invention.

Referring now to FIG. 12, a sheet transfer apparatus 501 according to another embodiment of the present invention is explained. The sheet transfer apparatus 501 of FIG. 12 is similar to the sheet transfer apparatus 301 of FIG. 9 except for a controller 511. The controller 511 is similar in structure to the controller 311, however, the controller 511 additionally provides a function for increasing the rotational speed of the second transfer roller 106 between position E' and position H'. In this example, position H' is provided anywhere downstream of position E' where the second transfer roller 106 is located.

In this example, the first transfer roller 105 is driven at a faster speed between positions E and E'. In addition, the second transfer roller 106 is driven at a faster speed between positions E' and H'.

Figure 13A:
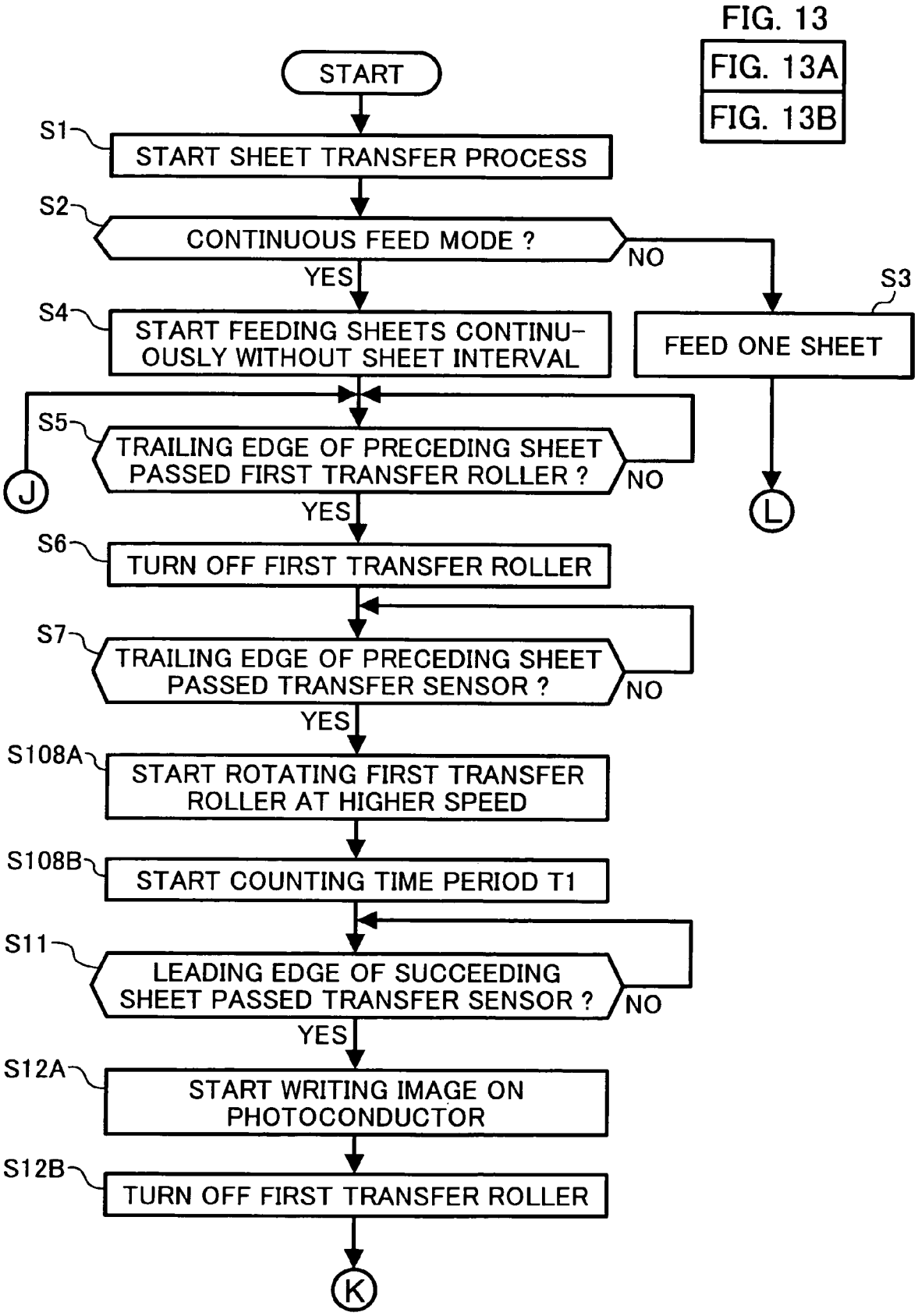
FIG. 13 is a flowchart illustrating a sheet transfer operation performed by the sheet transfer apparatus of FIG. 12.
Figure 13B:
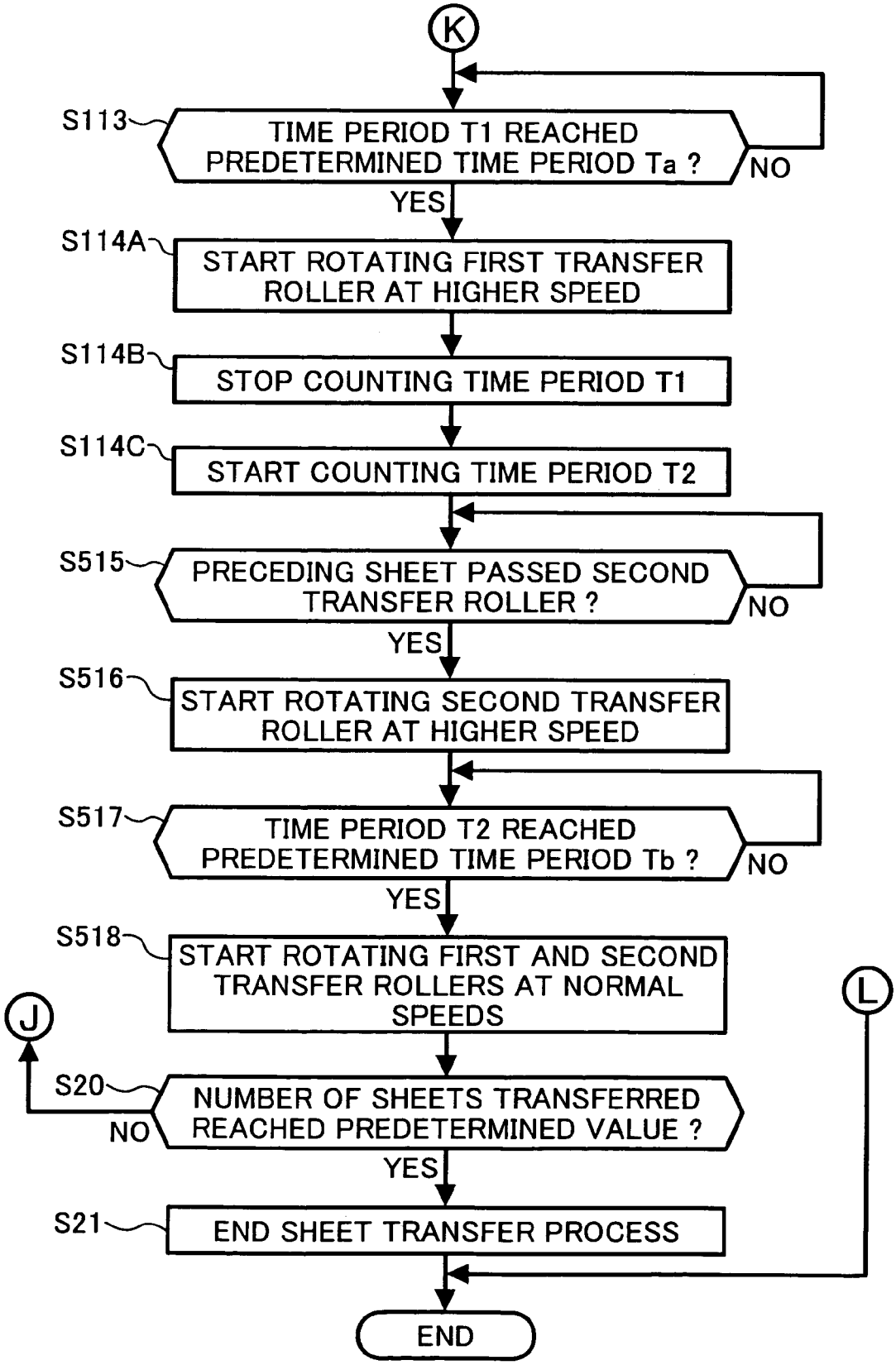

As shown in FIG. 13, the flowchart of the sheet transfer apparatus 511 is similar to the flowchart of the sheet transfer apparatus 301 shown in FIG. 9 except that steps S115 and S116 of FIG. 9 are replaced with steps S515 to S518 of FIG. 13.

Step S515 determines whether the trailing edge of the preceding sheet P1 has passed position E' where the second transfer roller 106 is provided. If the answer is no, the process repeats step S515. If the answer is yes, the process moves to step S516, which starts rotating the second transfer roller 106 at a speed faster than the normal speed used in the preceding steps.

Step 517 determines whether the time period T2 has reached a predetermined time period Tb. If the answer is no, the process repeats step S517. If the answer is yes, the process moves to step S518, which starts rotating the first and second transfer rollers 105 and 106 at the normal speeds.

Figure 14:
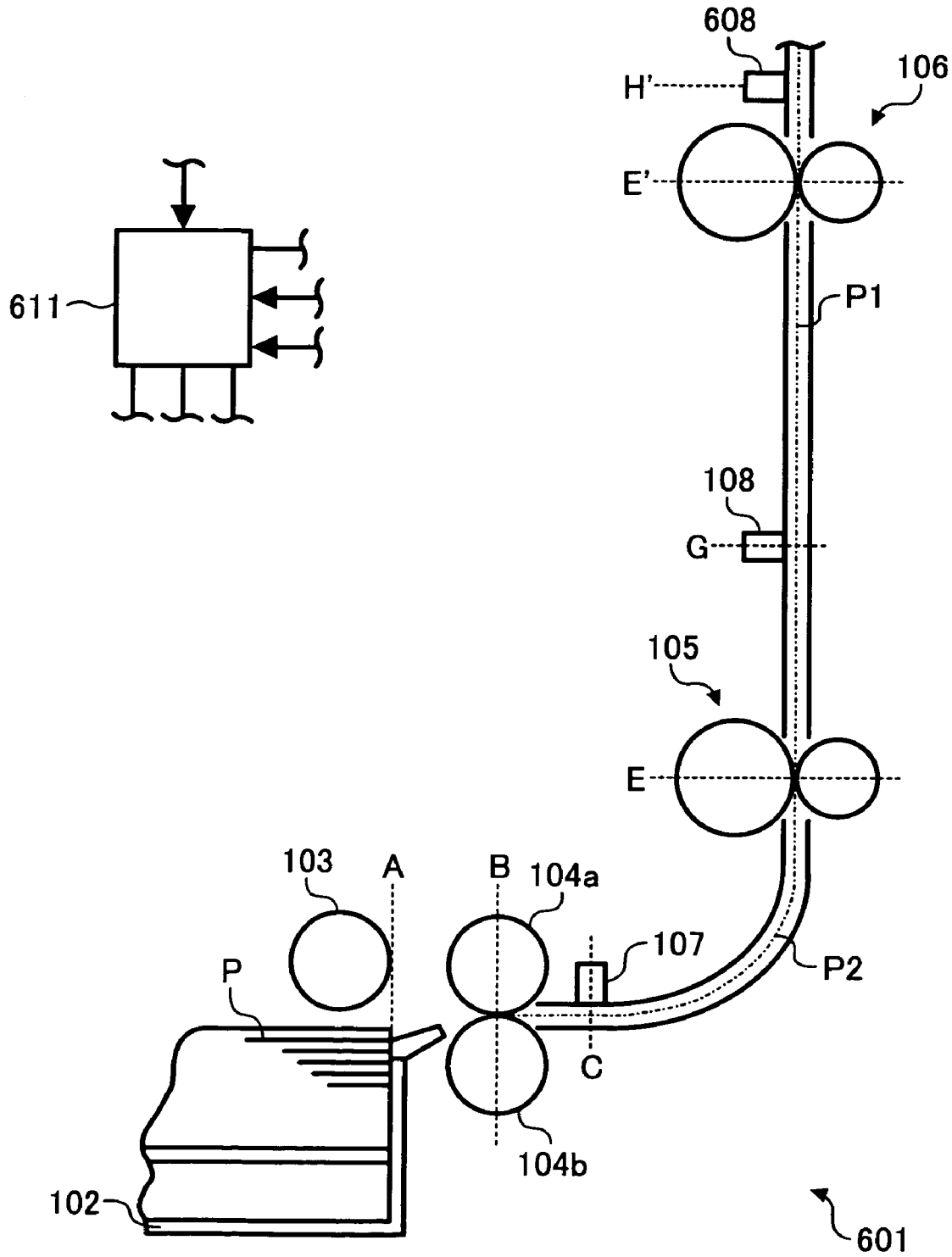
FIG. 14 is a schematic diagram illustrating a sheet transfer apparatus according to another embodiment of the present invention.

In another embodiment, as illustrated in FIG. 14, another downstream transfer sensor 608 may be provided at position H'. The transfer sensor 608 performs a function similar to the function of transfer sensor 108. Specifically, it detects the presence of the preceding sheet P1 and the succeeding sheet P2, and provides the detection result to the controller 511.

In any one of the above-described embodiments, a user may set any of the predetermined time periods T0, Ta, and Tb through the operational panel or through a communication line, etc., connected to any one of the above-described sheet transfer apparatuses. Further, in determining any of the predetermined time periods, various conditions on the recording sheet P including its size and surface type and/or various conditions on a roller in use including its speed and material may be considered.

Numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

What is claimed is:

1. An image forming apparatus, comprising:

an image forming mechanism for forming an image on a preceding sheet and a succeeding sheet; and a sheet transfer apparatus for transferring the preceding sheet and the succeeding sheet successively to the image forming mechanism, the sheet transfer apparatus, comprising:

a sheet tray containing the preceding sheet and the succeeding sheet;

a pick-up roller configured to successively feed the preceding sheet and the succeeding sheet from the sheet tray without a sheet interval therebetween;

a separator arranged downstream of the pick-up roller and configured to separate the preceding sheet and the succeeding sheet;

a first transfer roller arranged downstream of the separator and configured to transfer forward the preceding sheet and the succeeding sheet;

a second transfer roller arranged downstream of the first transfer roller and configured to transfer forward the preceding sheet and the succeeding sheet;

a first sensor provided between the first transfer roller and the second transfer roller and configured to detect the presence of the preceding sheet and the succeeding sheet; and a controller configured to generate a desired sheet interval between the preceding sheet and the succeeding sheet, wherein the desired sheet interval includes a first sheet and the succeding sheet interval and the controller generates the first sheet interval by stopping the first transfer roller for a first time period.

2. The image forming apparatus as defined in claim 1, wherein the first sheet interval corresponds to a distance between the first sensor and the first transfer roller.

3. The image forming apparatus as defined in claim 1, wherein the controller controls the second sheet interval so as to obtain the desired sheet interval.

4. The image forming apparatus as defined in claim 1, wherein a distance between the first sensor and the first transfer roller is greater than a distance between a downstream end of the sheet tray and the separator.

5. The image forming apparatus as defined in claim 1, wherein the first time period represents a time interval from approximately when a trailing edge of the preceding sheet passes the first transfer roller to approximately when the trailing edge of the preceding sheet passes the first sensor.

6. The image forming apparatus as defined in claim 1, wherein the first time period is previously set by the controller.

7. The image forming apparatus as defined in claim 1, wherein the first time period is determined based on an output from the first sensor.

8. The image forming apparatus as defined in claim 1, wherein the controller drives the first transfer roller at a normal speed after the first time period until a leading edge of the succeeding sheet reaches the first sensor.

9. The image forming apparatus as defined in claim 1, wherein the controller drives the first transfer roller at a speed faster than a normal speed until a leading edge of the succeeding sheet reaches the first sensor.

10. The image forming apparatus as defined in claim 1, wherein the controller generates the second sheet interval by stopping the first transfer roller for a second time period after a leading edge of the succeeding sheet reaches the first sensor.

11. The image forming apparatus as defined in claim 10, wherein the second time period is previously set by the controller.

12. The image forming apparatus as defined in claim 10, wherein the controller drives the first transfer roller at the normal speed after the second time period.

13. The image forming apparatus as defined in claim 10, wherein the controller drives the first transfer roller at a speed faster than the normal speed for a third time period after the second time period, and drives the first transfer roller at the normal speed after the third time period.

14. The image forming apparatus as defined in claim 13, wherein the third time period is previously set by the controller.

15. The image forming apparatus as defined in claim 13, wherein the sheet transfer apparatus further comprises:

a second sensor provided between the first sensor and the second transfer roller and configured to detect the presence of the preceding sheet and the succeeding sheet, wherein the third time period is determined based on an output from the second sensor.

16. The image forming apparatus as defined in claim 15, wherein the second sensor measures an actual sheet interval between the preceding sheet and the succeeding sheet, and the controller calculates the third time period based on the actual sheet interval.

17. The image forming apparatus as defined in claim 10, wherein the controller additionally drives the second transfer roller at a speed faster than the normal speed for a fourth time period after a trailing edge of the preceding sheet passes the second transfer roller, and drives the second transfer rollers at the normal speed after the fourth time period, when the third time period is greater than a time period corresponding to a distance between the first sensor and the second transfer roller.

18. The image forming apparatus as defined in claim 17, wherein the third time period is substantially equal to a sum of the fourth time period and the time period corresponding to the distance between the first sensor and the second transfer roller.

19. The image forming apparatus as defined in claim 17, wherein the sheet transfer apparatus further comprises:

a third sensor provided downstream of the second transfer roller and configured to determine an end of the fourth time period by detecting the presence of the preceding sheet and the succeeding sheet.

20. An image forming apparatus, comprising:

means for forming an image on a preceding sheet and a succeeding sheet;

containing means for containing the preceding sheet and the succeeding sheet;

means for successively feeding the preceding sheet and the succeeding sheet from the containing means without a sheet interval;

separating means for separating the preceding sheet and the succeeding sheet;

first transferring means for transferring the preceding sheet and the succeeding sheet forward from the separating means;

detecting means for detecting the presence of the preceding sheet and the succeeding sheet;

second transferring means for transferring the preceding sheet and the succeeding sheet forward from the detecting means; and generating means for generating a desired sheet interval including a first sheet interval and a second sheet interval between the preceding sheet and the succeeding sheet, wherein the generates the first sheet interval by stopping the first transferring means for a first time period.

21. The image forming apparatus as defined in claim 20, wherein the generating means generates the second sheet interval by stopping the first transferring means for a second time period after a leading edge of the succeeding sheet reaches the first detecting means.

22. The image forming apparatus as defined in claim 21, wherein the generating means drives the first transferring means at a speed faster than a normal speed for a third time period after the second time period, and drives the first transferring means at the normal speed after the third time period.

23. The image forming apparatus as defined in claim 22, further comprising:

second detecting means for detecting the presence of the preceding sheet and the succeeding sheet, wherein the third time period is determined based on the detection result of the second detecting means.

24. The image forming apparatus as defined in claim 23, wherein the second detecting means measures an actual sheet interval between the preceding sheet and the succeeding sheet, and the generating means calculates the third time period based on the actual sheet interval.

25. The image forming apparatus as defined in claim 22, wherein the generating means additionally drives the second transferring means at a speed faster than the normal speed for a fourth time period after a trailing edge of the preceding sheet passes the second transferring means, and drives the second transferring means at the normal speed after the fourth time period, when the third time period is greater than a time period corresponding to a distance between the first detecting means and the second transferring means.

26. The image forming apparatus as defined in claim 25, wherein the third time period is substantially equal to a sum of the fourth time period and the time period corresponding to the distance between the first detecting means and the second transferring means.

27. The image forming apparatus as defined in claim 25, further comprising:

third detecting means for determining whether the fourth time period ends by detecting the presence of the preceding sheet and the succeeding sheet.

* * * * *